United States Patent [19]

Person

[11] 4,164,216

[45] Aug. 14, 1979

[54] THROAT OBSTRUCTION EXPULSION DEVICE

[76] Inventor: Orville W. Person, 7612 202 Place SW., Edmonds, Wash. 98020

[21] Appl. No.: 872,642

[22] Filed: Jan. 26, 1978

[51] Int. Cl.[2] ..... A61H 31/00

[52] U.S. Cl. ..... 128/28; 128/54

[58] Field of Search ..... 128/1 R, 28, 54, 60, 128/303 R, 2 N, 2 R, 44, 51, 55; 272/134–138, 143, 144

[56] References Cited

U.S. PATENT DOCUMENTS

| | | | |
|---|---|---|---|
| 1,050,836 | 1/1913 | Jones | 128/60 |
| 1,842,323 | 1/1932 | Gluzek | 128/2 N |
| 3,219,031 | 11/1965 | Rentsch, Jr. | 128/28 |
| 3,228,392 | 1/1966 | Speyer | 128/55 |
| 3,401,686 | 9/1968 | Edwards | 128/28 |
| 3,744,484 | 7/1973 | La Torraca | 128/54 |
| 4,059,099 | 11/1977 | Davis | 128/28 |

*Primary Examiner*—William E. Kamm
*Attorney, Agent, or Firm*—Boniard I. Brown

[57] ABSTRACT

A device to aid victims of choking attacks, by assisting in the expulsion of objects lodged in the larynx through the compression of the upper abdomen and the discharge of air from the lungs, is constructed with anchor means for attachment to a wall, table or other solid object and a hinged connection to a track member along which a slider assembly reciprocates. The slider assembly is provided with an impact pad which may be aimed at the upper abdomen and with handgrips for exerting muscular effort on the pad to cause the compression of the lungs. The track member and the slide are constructed from telescoping tubing segments in the preferred embodiment. The handgrips may be operated either by the victim of the choking attack or by another.

8 Claims, 6 Drawing Figures

40
100
10
24a
200
14
20
26
2
10
14

24a
100
12
16
20
22
24b
26
30
2
26
126
24b
14
100
26
10
20

50
40
10
14

20
22
100
28
30
12
16
18
24a
26
11
110
110B
110C
11
D 110A
100
200

300
110
100

THROAT OBSTRUCTION EXPULSION DEVICE

BACKGROUND OF THE INVENTION

The invention relates to devices for the expulsion of bodies obstructing the larynx; it relates, more particularly, to devices by which such expulsion is caused by a rapid compression of the lungs through the application of a sharp blow to the upper abdomen.

The accidental obstruction of the larynx and of the windpipe is a very frequent cause of medical emergency and, according to Drs. MAYER and DWYER, in "Choking at Mealtime: the Silent Killer" published in the Los Angeles Times on August 18, 1977, ranks sixth among the causes of accidental death. Such obstructions commonly occur due to the improper ingestion of food at home, in restaurants and even in hospitals. The greatest danger to the victim lies in the fact that the cause of this sudden choking attack is frequently misinterpreted, commonly as a heart attack, and even in the presence of trained medical personnel death may ensue due to his inability to communicate verbally the state of facts.

While the extraction of the food particle, most commonly a chunk of improperly chewed meat, from the throat is possible with the aid of someone's fingers or an appropriate appliance, the most efficacious method for disloding such matter is through the "Heimlich Maneuver" named after Dr. Henry Heimlich of the Cleveland Jewish Hospital. This procedure involves the rapid compression of the upper abdomen so as to expel the air trapped in the lungs and to propel the plug of obstructing material from the larynx.

The Heimlich Maneuver is most readily performed by a second person standing behind the accident victim and clasping his hands in front, just below the ribcage. In many cases, it may also be applied by the accident victim himself, but the available leverage is necessarily reduced and the effectiveness lessened.

Since the accident victim is the only person present with a clear understanding of what is happening, it is of great benefit to him if an appliance or device may be provided which would increase the efficiency of the abdominal compression process, whether applied by himself or by another.

It is, therefore, a primary object of the invention to provide a simple device for the rapid and efficient performance of the Heimlich Maneuver, to aid in the expulsion of obstructions from the larynx of a victim of a choking accident.

It is a further object of the invention to provide a device with the aforementioned characteristics which is simple in form, easy to operate, and readily provided for in establishments, such as restaurants, where the likelihood of a choking occurrence is foreseeable.

It is an additional object of the invention to provide a device for assisting in the expulsion of objects lodged in the larynx and windpipe of an accident victim which is adapted to economical manufacture, requires no maintenance, and which may be readily affixed, permanently or temporarily, to a solid object, to aid in the efficacious operation thereof.

The device in which the foregoing objects of the invention, as well as other objects and advantages which shall become apparent from the detailed description of the preferred embodiment thereof, are attained comprises a cylindrical track member, pivotally attached to an anchor, and a slider reciprocable on, or within, the track member. The slider is provided with suitable handgrips for propulsion and with an impact pad at its outboard end.

In use, the device is attached, by means of the anchor, to a solid object, a wall or table for example, and the pad aimed at the center of the abdomen just below the ribcage. The pad is then impelled into the abdomen using the handgrips, thereby compressing the lungs and expelling the air contained therein. It is the sudden discharge of air from the lungs through the windpipe which secures the expulsion of the object blocking the larynx.

In General, the aforementioned anchor is provided with a suction cup for ready attachment to a solid body with a smooth surface, but, especially suitable for use in a restaurant, it may also be permanently affixed, by means of screws or adhesive, at a level substantially corresponding to the abdominal height of the average person.

The impact pad is suitably made as a circular metal body with a curved contact face, so as to prevent superficial damage to the user, and of the proper size to enhance the impact delivered to the diaphragm. Alternately the pad, as well as the other parts of the device, may be constructed from a high-impact plastic composition.

The preferred embodiment of the invention will be described below with reference to the accompanying drawing, in which.

Figures 1, 2, 3, 4, 5, 6:
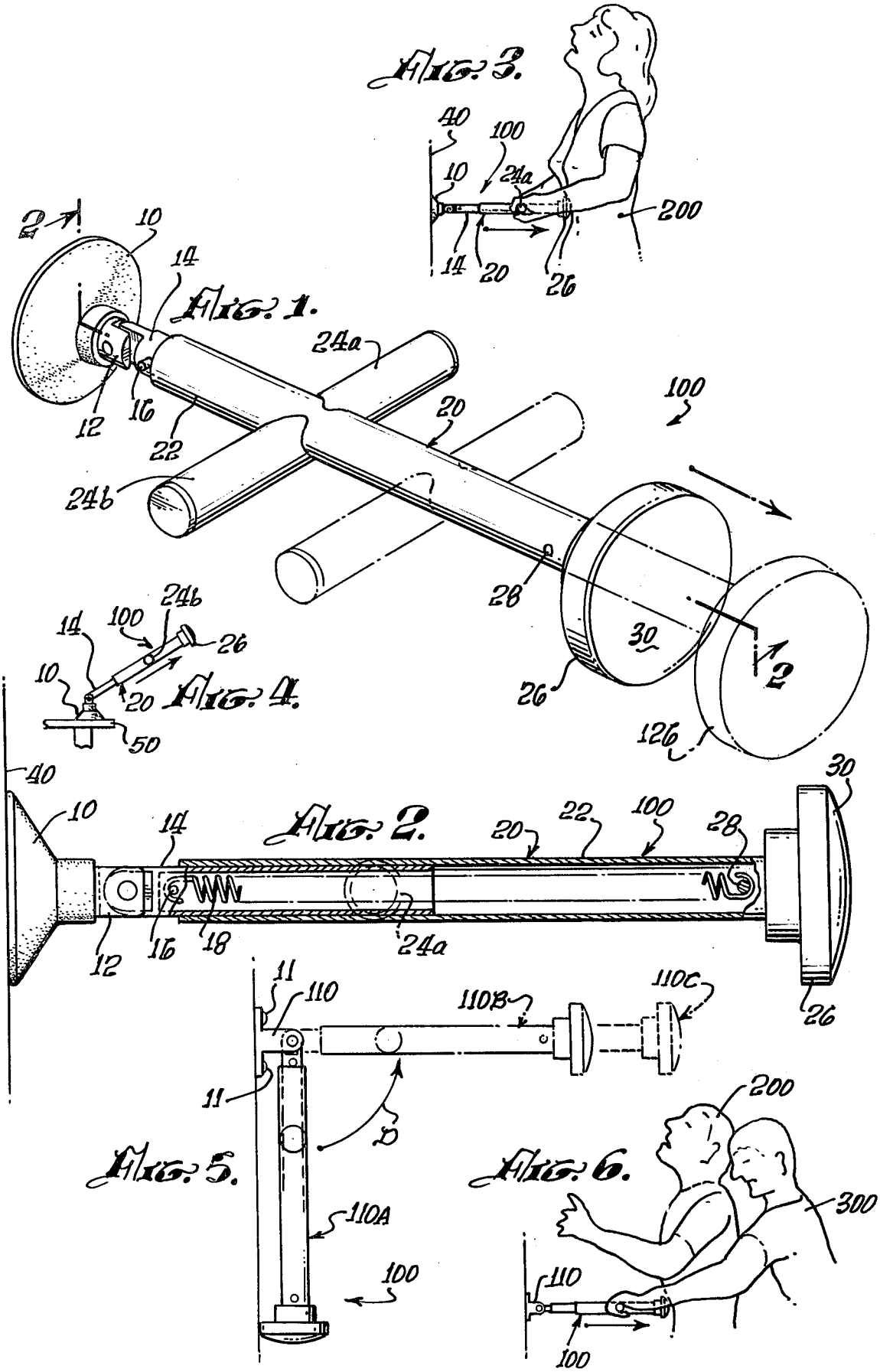
FIG. 1 is a perspective view of the throat obstruction expulsion device of the invention in the static condition, with the extended position of the slider assembly indicated by a broken outline.
FIG. 2 is a transverse section, taken along section line 2—2 in FIG. 1, of the embodiment shown in the preceding Figure, particularly illustrating the interaction of the track and slider members and of an extension spring employed to maintain the two halves of the device in the proper register in the static condition.
FIG. 3 is a side view of the device of FIGS. 1 and 2 employed by a choking accident victim, with the device anchored to a wall surface by means of its integral suction cup.
FIG. 4 is another side view of the throat obstruction expulsion device, secured to a table-top in readiness for use.

FIG. 5 is a side elevation of an alternate embodiment of the invention, utilizing a permanent anchor secured to a wall surface, in alternate stored and use positions and with the slider extended (shown in dotted outline) in use; and FIG. 6 is another side view, showing the embodiment of FIG. 5 being applied to a choking victim by another person, to secure the expulsion of an object lodged in the throat of the former.

DESCRIPTION OF THE PREFERRED EMBODIMENT

In FIG. 1 we see a perspective view of a throat obstruction expulsion device 100, comprising an anchor 10, a track member 14, a hinge 12 interconnecting the anchor and the track member, and a slider assembly 20. The slider assembly 20, in turn, comprises a slide 22, a bilateral handgrip with righthand are *24a* and left-hand arm *24b*, and an impact pad 26. Not visible in this view is a spring 18 which is anchored by pins 16 and 28, located in the track and slide members, respectively, condition—i.e. fully engaged upon the track tube 14.

The spring 18 is constructed with a relatively low spring rate, so that it does not exert a substantial restraining force to the extension of the slider assembly 20 into the working condition, exemplified by the dotted outline of that assembly and, particularly, by the position of the impact head 26 in the location indexed at 126. The travel of the slider assembly 20 is relatively short, of the order 2 or 3 inches in the optimal employment of the device, and corresponds to the desired compression of the upper abdomen necessary to attain the rapid expulsion of air from the lungs.

FIG. 2 is a transverse section of the embodiment of FIG. 1, taken along section line 2—2, showing the relative positions of the several components in the static condition. In both FIGS. 1 and 2 the device is shown as if attached to a wall surface and aligned horizontally, ready for employment in the expulsion of an obstruction from the larynx of an accident victim 200, in the manner more fully illustrated in FIG. 3.

The particular details of interest in FIG. 2 are: the development of the anchor 10 as a suction cup, made from an elastomeric material, readily attached to a smooth surface; the development of the hinge 12 as a yoke assembly with a central blade attached to the anchor 10 and a mating yoke attached to the track tube 14; the retention of the retaining spring 18 within the tubular inner volume defined by the internal diameter of the reciprocating assembly formed by the track 14 and the slide 22; and the hemispherical contour 30 of the impact pad 26 which contacts the body of the user.

The illustrative view of FIG. 3 shows the user 200 employing the device 100, which had been previously attached to a wall 40 by means of the suction cup 10 at approximately the elevation of the upper abdomen. The use of the device 100 materially increases the effectiveness of the effort which may be developed by an individual in the throes of a choking attack, both due to the concentration of the applied force by means of the impact ram, and by greater muscular effort which may be applied via the handgrip 24, as opposed to an unaided use of the clenched fists pressed against the diaphragm.

FIG. 4 is a side view, illustrating the manner in which the device 100 may be attached, through the use of anchor 10, to a table 50; the hinge assembly 12 allowing the adjustment of the elevation of the impact pad 26 to the stature of the user.

FIG. 5 illustrates an alternative embodiment 110 of the anchor, adapted to be secured to a fixed object, represented by the wall 40 by means of threaded fasteners 11. This side view also illustrates the manner in which the hinge 12 allows the device to be stored in an unobtrusive manner (indicated by the position 110A) proximate to the wall, yet adapt it to instant employment, represented by the compressed condition 110B and the fully extended condition 110C, through rotation in the sense of the arrow D. Such permanent installation is of particular benefit in locations, principally restaurants and hospitals, where the frequency of occurence of choking accidents is high and where personnel can be readily trained to provide assistance to a choking victim immediately upon diagnosis of the cause of their distress.

The use of the device 100 by a person 300, rather than the victim 200, is illustrated in FIG. 6, where the accident victim is supported in an upright position and the handlebars 24 operated by the person 300.

It should be noted that the device 100 may be employed in conditions other than those illustrated. It is effective when used in other positions, and on a child; small children being frequent victims of choking attacks, and in other circumstances.

The construction of the throat obstruction expulsion device is readily adapted to conventional techniques: it may be made from plastic materials or from metallic tubing as the principal constituents; the relative shapes of the track and slide may take different forms, although the tubular, telescoping construction shown is the preferred mode. The use of an anchor greatly facilitates employment in that the user need not worry about proper location and alignment and may concentrate on the rapid compression of the diaphragm, thereby attaining the optimum expulsion velocity of the gases in the lungs, and greatest possible pressure wave impact on the obstruction in the larynx.

The device of the invention has been described above with reference to the preferred embodiment. Changes in the dimensions, constructional materials, or constructional details thereof shall be deemed to be encompassed by the disclosure; for example; in the nature of, and relative motion permitted by, the hinge 12 interconnecting the anchor and the track. The invention shall be delimited solely by the appended claims.

The inventor claims:

1. A device for expelling an object lodged in the larynx of a person through the compression of the upper diaphragm, comprising:
   - anchor means adapted to be secured to a planar surface; an elongated track member;
   - hinge means affixed at either end to said anchor means and said track member, respectively, and allowing for rotational freedom therebetween in at least one plane; a slide reciprocable along said track member;
   - handgrip means affixed to said slide for manually imparting reciprocal motion thereto;
   - an impact pad affixed at the end said slide remote from said hinge means; and
   - retention means for preventing the disengagement of said track member from said slide.

2. The device of claim 1, wherein said track member and said slide are formed as telescoping tubular elements.

3. The device of claim 1, wherein said anchor means include a suction cup for adhesive engagement with said surface.

4. The device of claim 1, wherein said anchor means include threaded fasteners for engaging said surface.

5. The device of claim 2, wherein said retention means includes an extension spring located within said telescoping tubular elements and anchored to said track member and said slide proximate to said hinge means and said impact pad, respectively.

6. The device of claim 5, wherein said impact pad is formed as a circular flange with an arcuate outer face, encompassing said remote end of the slide.

7. The device of claim 1, wherein said handgrip means include handlebars extending orthogonally from either side of said slide in mutual axial alignment.

8. The device of claim 2, wherein said telescoping tubular members are formed from metallic tubing.

* * * * *